US005911184A

United States Patent [19]

Tayrien et al.

[11] Patent Number: 5,911,184

[45] Date of Patent: Jun. 15, 1999

[54] SEWING MACHINE GUIDE

[75] Inventors: Steven R. Tayrien, Northridge; Peter A. Terranova, Sherman Oaks, both of Calif.

[73] Assignee: Wizard Attachment Co., Inc., Northridge, Calif.

[21] Appl. No.: 08/953,625

[22] Filed: Oct. 17, 1997

[51] Int. Cl.[6] ..... D05B 35/00

[52] U.S. Cl. ..... 112/136; 112/235; 112/470.31

[58] Field of Search ..... 112/136, 240, 112/470.31, 152, 305, 151, 153, 235

[56] References Cited

U.S. PATENT DOCUMENTS

| | | | |
|---|---|---|---|
| 577,595 | 2/1897 | Close | 112/136 |
| 684,990 | 10/1901 | Laubscher | 112/136 |
| 1,277,954 | 9/1918 | Kurtz | 112/136 |
| 1,352,675 | 9/1920 | Moffatt | 112/136 |
| 1,765,169 | 6/1930 | Mann | 112/136 |
| 1,790,351 | 1/1931 | Little | 112/136 |
| 2,208,992 | 7/1940 | Lewis | 112/136 |
| 2,915,996 | 12/1959 | Charest | 112/151 |
| 4,321,880 | 3/1982 | Boser | 112/151 |
| 4,590,876 | 5/1986 | Mencke et al. | 112/153 |
| 5,394,813 | 3/1995 | Shimoyama et al. | 112/470.31 |

*Primary Examiner*—John J. Calvert
*Assistant Examiner*—Tejash D Patel
*Attorney, Agent, or Firm*—Fulbright & Jaworski LLP

[57] ABSTRACT

An improvement to a sewing machine which allows ribbons, trim, elastic bands and other linear-shaped materials to be accurately and automatically controlled and guided as they are fed into the sewing mechanism. For elastic, an adjustable control is provided that automatically prestretches the elastic as it feeds into the machine. This control allows the user to adjust the amount of tension in the elastic, and thus control the amount of stretch which is sewn into the finished product. These features are implemented in a hands-free manner, so the operator is not burdened with having to manually guide the materials while simultaneously tending to all the other manual duties that a sewing machine operator must typically contend with. The invention is implemented with one or more guides which can be mounted on the sewing machine foot. Custom feet are provided to allow the invention to be retrofitted onto existing sewing machines.

13 Claims, 7 Drawing Sheets

SEWING MACHINE GUIDE

BACKGROUND OF THE INVENTION

1. Field of the Invention

The invention relates to an improvement to a sewing machine. More particularly, the invention relates to an improvement that allows certain materials to be controlled and fed into the sewing mechanism of a sewing machine in a hands-free manner.

2. Description of the Related Technology

The heart of the basic sewing machine is referred to herein as the "sewing mechanism", and typically contains an upper and lower part. The upper part contains a needle, a source of thread for the needle, and a foot which acts to hold the material down. The lower part contains a flat base, a secondary source of thread called a bobbin, and a set of movable gripping teeth. In operation, the materials being sewn pass between the upper and lower parts. The materials lay on the top surface of the base, are held flat against the base by the foot, and are moved forward by the action of the teeth. Interaction between the needle and the bobbin sews the fabric together at a location directly beneath the foot. This basic process has remained relatively constant since the sewing machine was invented many years ago. However, a great many improvements have been developed which allow specialized functions to be performed. These improvements generally permit such functions to be performed automatically by the machine rather than depending on the skill of the operator to perform them. Examples of such improvements are the capability for making button holes, for sewing specific types of seams, and for sewing decorative applique designs on the material.

One area which has not benefitted from such automation, however, is the attachment of elastic to predominantly non-elastic materials. For such an attachment to work properly, the elastic must be prestretched before being sewn to the material and it must remain stretched as it is being sewn. Once the elastic has been sewn and released, it returns to its normal non-stretched configuration. The result is an area of material, such as the waistband of a dress, which is normally in a "gathered" configuration but can be stretched to a larger dimension. The extra gathered fabric allows the normally non-stretchable material to effectively be stretched, while the tension in the stretched elastic provides the proper force to hold the article of clothing snugly in place.

In a typical sewing machine, the operator must manually hold the elastic in a stretched position by hand while feeding it and the fabric into the sewing mechanism. Since the operator must accurately guide the fabric and the elastic while simultaneously maintaining the proper tension on the elastic, the resulting operation is awkward and requires a great deal of skill on the part of the operator. If other materials are simultaneously being sewn into the same area, this just compounds the problem. What is needed is a device that will prestretch the elastic as it is being sewn without requiring any manual intervention by the operator.

In a related area, sewing machine operators sometimes wish to sew multiple strips of linear material, such as elastic, ribbons, strips of lace, etc., onto the same area of fabric at the same time, while accurately maintaining these strips of material in a particular configuration with respect to each other. This function requires the operator to manually guide these multiple strips and accurately maintain their proper position while simultaneously tending to the other manual operations that the operator must perform. These multiple manual operations require a great deal of skill on the part of the operator, and increase the chance for error. What is needed is a mechanism that will automatically guide various sizes of ribbon and other linear material into the sewing mechanism while accurately maintaining their proper positional orientation.

For widespread acceptance, the aforementioned needs should be met by a device that is inexpensive and simple to use so that it will appeal to the many people who sew in their homes on their personal sewing machines. It should also be capable of being easily retrofitted onto existing sewing machines.

SUMMARY OF THE INVENTION

The invention described herein solves the aforementioned problems of the prior art through the use of a guide or a family of guides that may be affixed to a sewing machine. These devices can be affixed and operated by persons of minimal skill and experience. In a preferred embodiment, the heart of the invention is a guide which attaches to the so-called foot of the sewing machine. The foot is a ski-shaped device which rests on top of the material being sewn and holds that material down. Since the foot is in close proximity to the needle and is used to help guide material under the needle, it represents an ideal location for attachments which will further automate this process. An example of a typical foot is shown in FIG. 2, while a foot that has been modified for the invention is shown in FIG. 3. Two examples of the guide are shown in FIGS. 4A and 4B. As can be seen, the guide has a slot that penetrates the guide from top to bottom. The elastic, ribbon or other trim material feeds into this slot, which acts to accurately hold the trim material in place before it feeds into the sewing mechanism. Since positional accuracy is important, the width of this slot should be identical to, or slightly larger than, the width of the trim material being used. Since trim material comes in various widths, a family of guides with slots of various widths can be used. It is also possible to put a mechanical adjustment on the device which allows the operator to vary the width of this slot, thus allowing the operator to accommodate various sizes of trim with a single (but more complicated) guide. As shown in FIG. 4A, the guide also has a second non-enclosed slot. This is used to attach the guide to the foot. The foot must have a corresponding protrusion which fits into this non-enclosed slot when the guide is mounted to the foot. Since sewing machine feet typically do not come with such a protrusion, a special foot designed for such a purpose is normally necessary. The combination of non-enclosed slot on the guide and protrusion on the foot represent a preferred embodiment. However, other forms of mounting the guide on the foot might also be used, such as enclosed slots, spring clips, screws, etc.

In a typical home sewing machine, the invention will include a replacement foot which has been designed to take the place of the standard foot that came with the machine. The portion of the foot that attaches to the sewing machine can be custom-designed to fit that particular brand and model number of sewing machine, while the guide mount can be common to all such feet. Since the guide protrusion does not interfere with normal sewing, this specialized foot may remain on the sewing machine for standard operation when the guide is not being used. This combination of a custom foot with easily interchangeable guides allows the home operator a great deal of flexibility at low cost. Alternatively, for a more rigid mounting the guide can be attached to the sewing machine shank (or other portion of the sewing machine) by using a bracket, and the alignment portion can be either permanently or interchangeably connected to that bracket.

While the aforementioned slot can guide the trim material, an additional control is needed for prestretching elastic. This is accomplished by the screw 9 shown in FIG. 4A. Once the elastic has been fed through the guide and is in place, the operator simply turns this screw until it contacts the elastic. By adjusting the screw, a variable amount of frictional force can be applied to the elastic. As the elastic is pulled through the slot by the action of the sewing machine, this frictional force tends to hold the elastic back, resulting in the elastic being stretched as it feeds into the machine. Turning the screw to adjust this tension will adjust the amount of stretch which is introduced into the elastic as it is sewn. This gives the operator the ability to control the amount of stretch which is automatically sewn into the elastic.

In an alternative embodiment, this device can also be used to feed multiple ribbons or other such trim pieces into the sewing mechanism at the same time. By having multiple slots, possibly of different widths, multiple such ribbons can be fed into the machine simultaneously and their desired orientation can be maintained without requiring the operator to manually hold them in place. As before, slots of various widths can be provided on different guides, or a single guide can have mechanical adjustments to control the width of these slots. Due to the simple design and inexpensive nature of the basic guide, the preferred embodiment uses multiple guides with different size slots rather than incorporating adjustable slots into a more complicated single guide.

In another embodiment, the guide does not attach to a foot at all, but instead attaches to the shank (which is normally located above the foot and can provide an attachment point for the foot) or to another point in the upper part of the sewing machine. An example of this version is described in U.S. design application Ser. No. 29/067,696, filed Mar. 5, 1997 and entitled "Elastic Applique Guide for Sewing Machine". That document is incorporated herein by reference in its entirety.

DETAILED DESCRIPTION OF THE INVENTION

Figure 1:
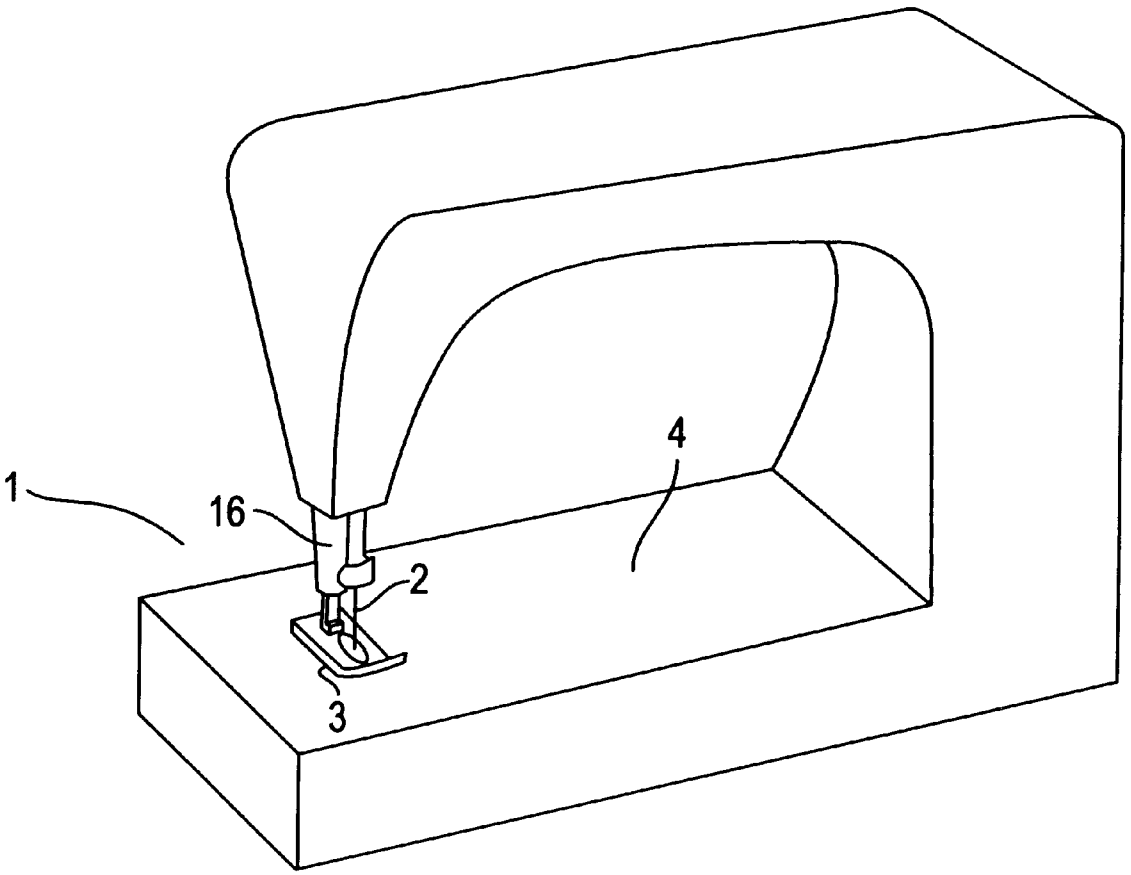
FIG. 1 (PRIOR ART)
FIG. 1 shows a standard sewing machine of the prior art.

FIG. 1 shows a standard sewing machine. The sewing mechanism 1 includes a needle 2, a shank 16, and a foot 3 that attaches to the shank, all of which are attached to the upper portion of the machine. The upper portion also contains a source of thread (not shown) which provides thread to the needle 2. The bottom portion of the machine contains a base 4. Directly underneath the foot, the base contains a set of moving teeth and a secondary source of thread called a bobbin (not shown because they are obscured by the foot). As the fabric being sewn passes between the base and the foot, the needle and bobbin move and interact in a manner that causes the fabric to be sewn with thread from the two thread sources. At the same time, the small moving teeth in the base grip the fabric from underneath and move it forward as it is being sewn. In normal operation, the operator feeds two or more layers of fabric across the top of the base of the sewing machine and underneath the foot where the aforementioned action sews the fabric together. Various adjustments in the machine allow the operator to control the tension in both threads, the speed of the operation, and the pressure of the foot on the material, all of which can affect the quality and appearance of the finished result.

Figure 2:
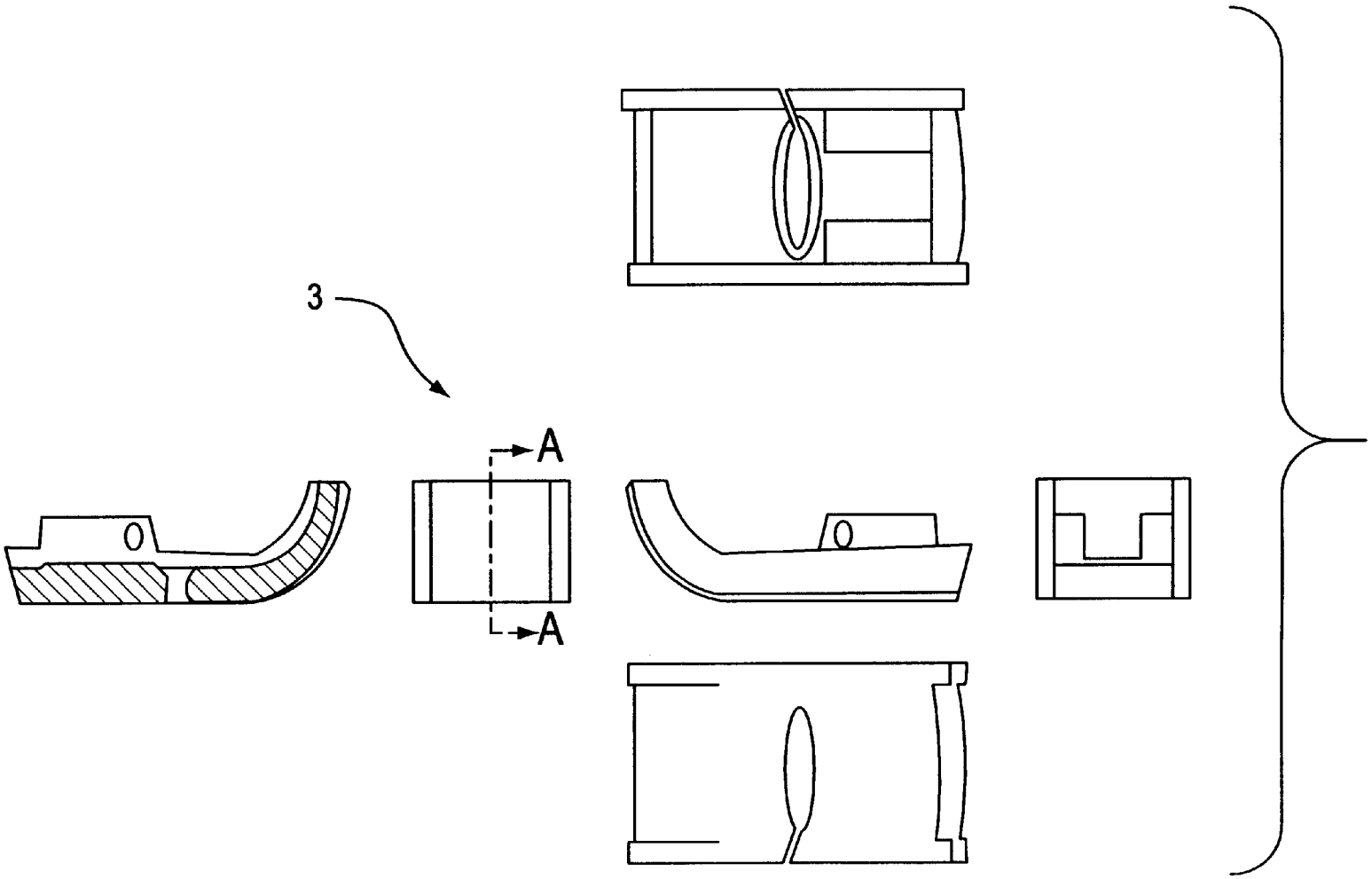
FIG. 2 (PRIOR ART)
FIG. 2 shows a standard sewing machine foot of the prior art.

FIG. 2 shows a detailed view of a standard foot 3, which has the general shape of a ski. Being curved and raised at the front end allows the operator to feed material underneath the foot without snagging or catching. The needle moves up and down through the hole in the center of the foot and the fabric is sewn at that point. The sewn fabric exits from underneath the back of the foot.

Figure 3:
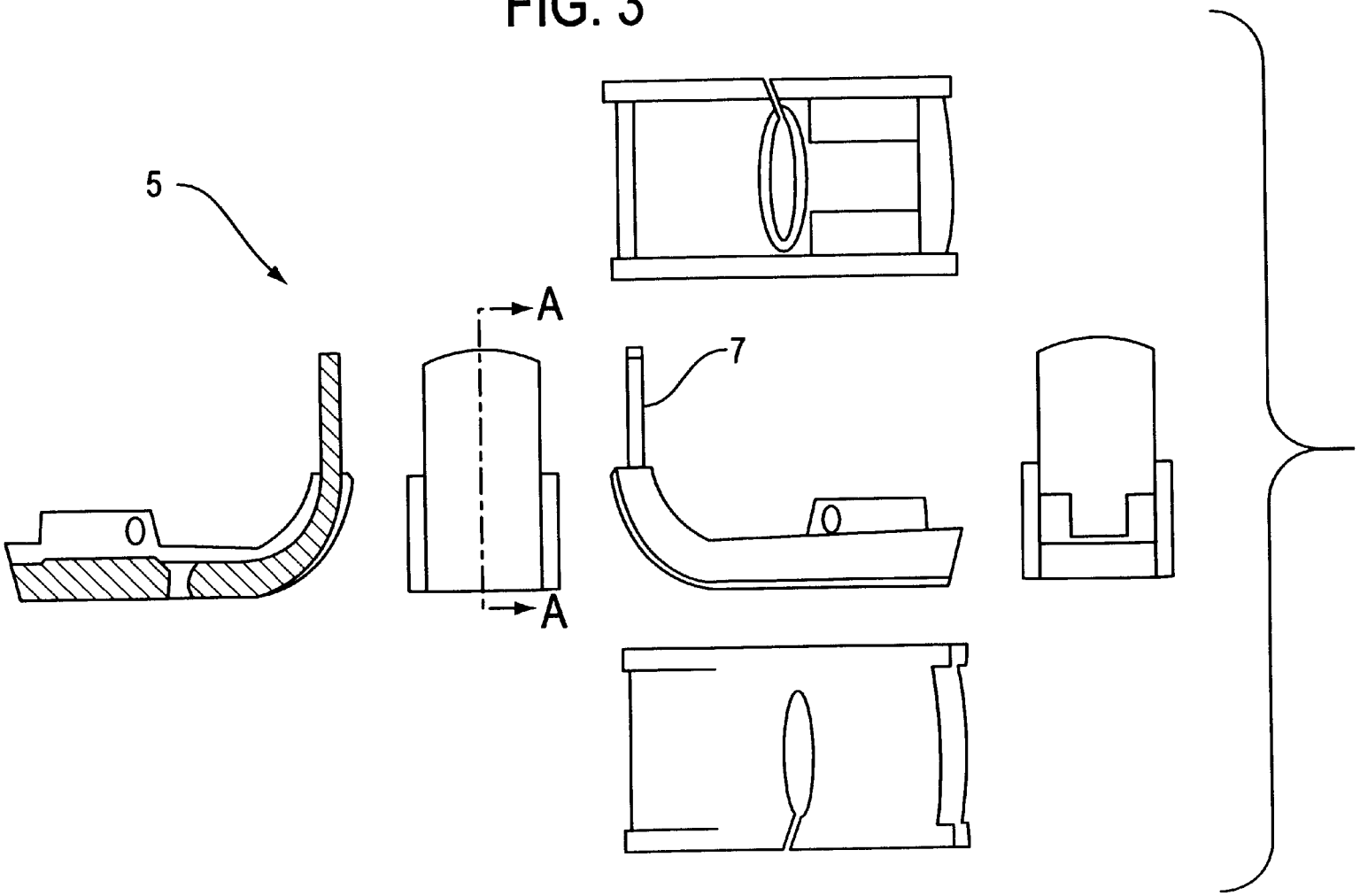
FIG. 3 shows the sewing machine foot of the invention.

Foot 5 of the current invention is shown in FIG. 3. It differs from a standard foot by having a vertical protrusion 7 rising from the front end. This vertical protrusion provides a mount for the various guides which can be simply slid onto the protrusion from above. The purpose of these guides is to hold and control various types of trim, such as ribbon, elastic, or other materials with a generally linear shape.

Figure 4A:
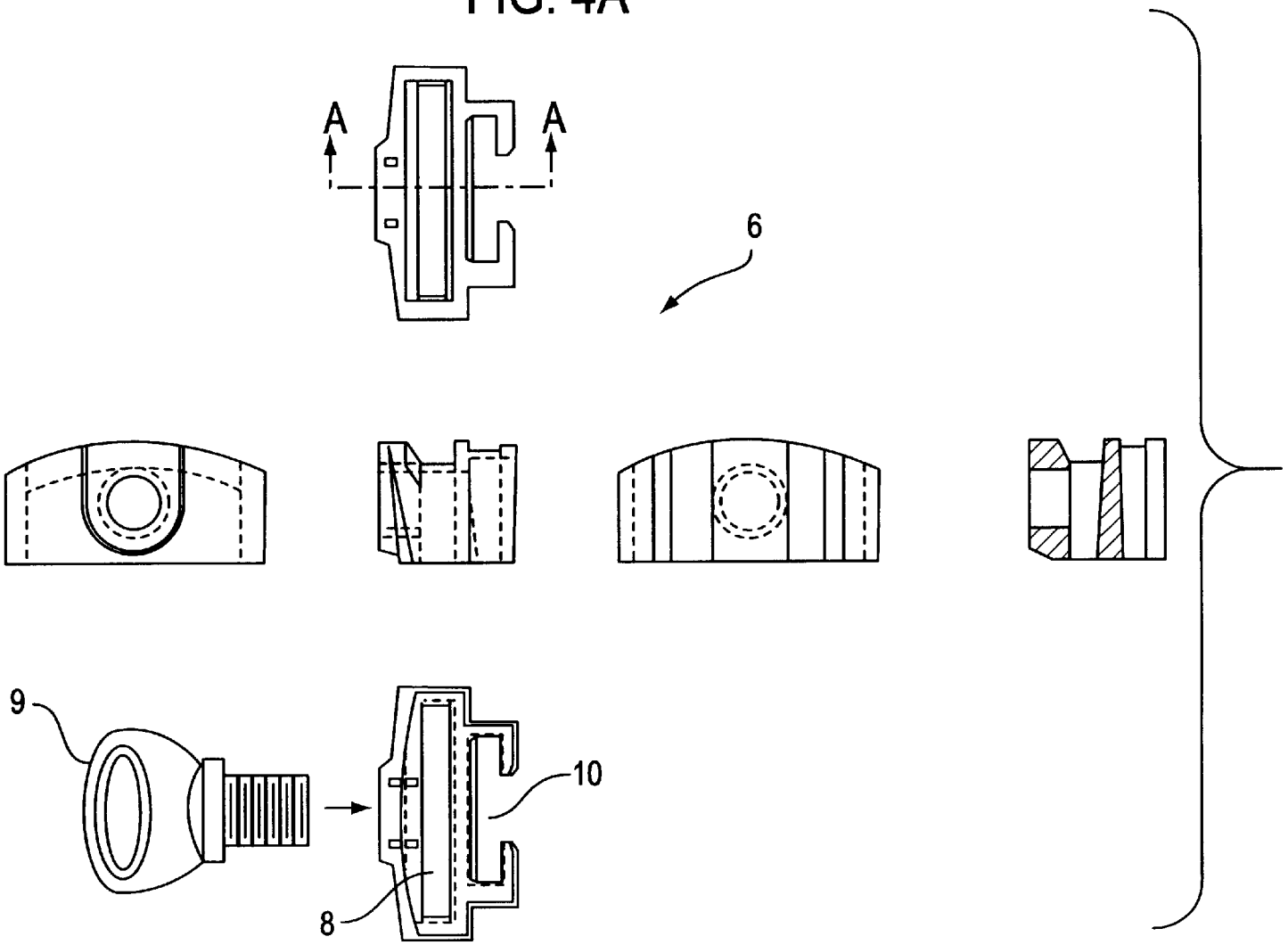
FIGS. 4A and 4B show guides for prestretching elastic.

FIG. 4A shows one embodiment of a guide 6 which is designed for use with elastic. The elastic feeds downward through slot 8 which extends all the way from top to bottom. The top edge of this slot can be beveled to prevent the elastic from snagging and catching as it feeds into the slot. Other edges can be beveled as well. The width of this slot is identical to, or slightly larger than, the elastic being used. This maintains the elastic in accurate alignment as it feeds out the bottom of the slot and into the sewing area underneath the foot. Non-enclosed slot 10 is used to mount guide 6 to protrusion 7 on foot 5.

Screw 9 enters the guide from the front side and penetrates into the slot containing the elastic. By turning the screw inward, the operator can force the elastic against the back wall of the slot. When the elastic is pulled through the slot, this force creates a frictional resistance between the elastic and the back wall of the slot, and also between the elastic and the screw itself. Adjusting the position of the screw allows the operator to provide variable amounts of force on the elastic. This provides a controllable frictional force which resists the pull of the elastic through the slot. As illustrated, screw 9 can be a thumbscrew with a wide flat head to provide more precise control of its position. As previously described, the sewn fabric is fed across the top of the base by the action of moving teeth underneath the material. Since the front end of the elastic has already been sewn to the fabric, these teeth cause the sewn portion of the elastic to be pulled forward. This pulling action, resisted by the friction within the guide slot, causes the elastic to be stretched. Once the stretched elastic creates a tension greater than this frictional force, the elastic within the guide will move forward. By controlling the position of the screw, and thus the amount of friction, the operator can control the amount of stretch which is being sewn into the elastic.

Figure 4B:
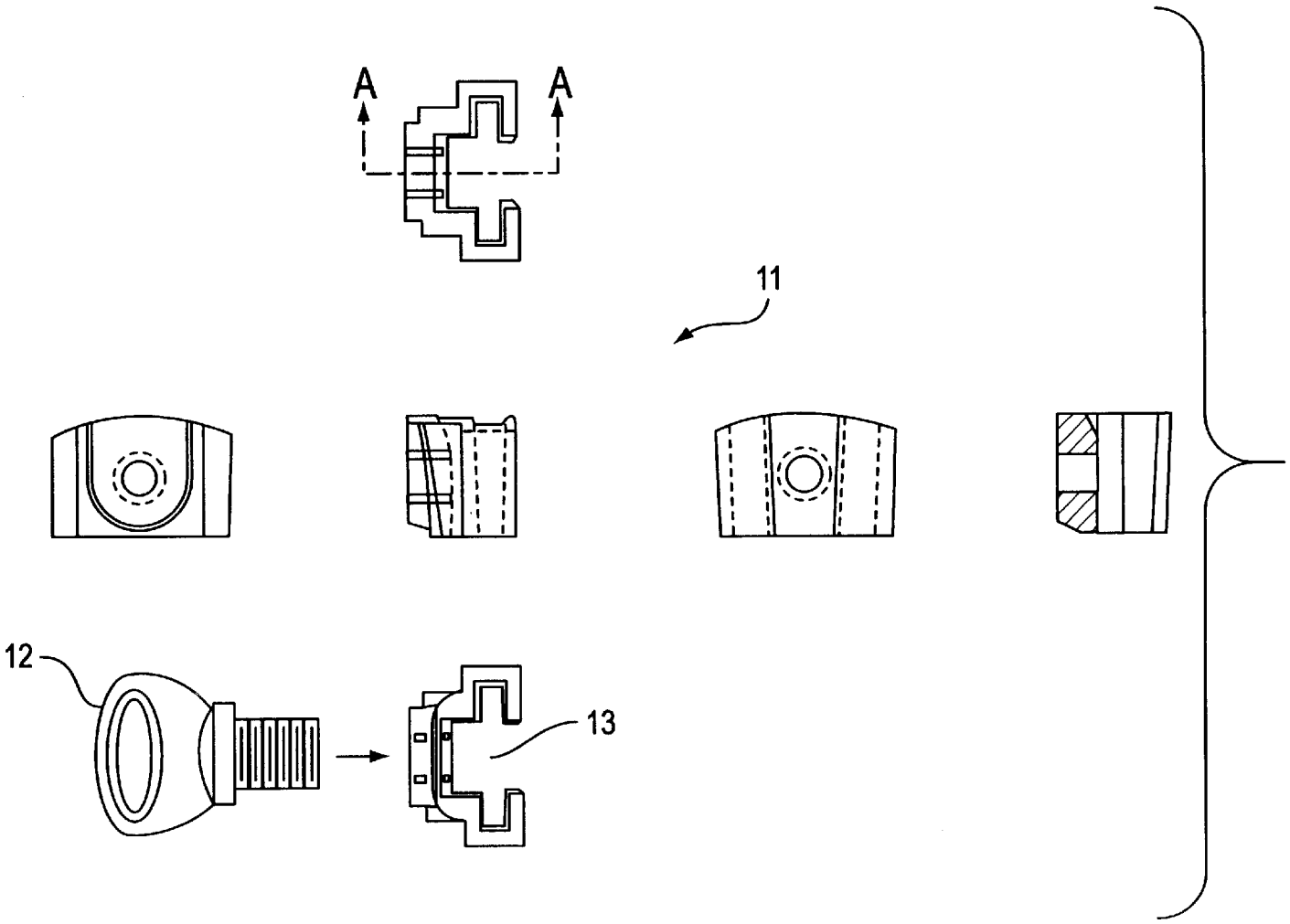

Guide 11 of FIG. 4B represents a slightly different embodiment. In this version, a single staggered-width slot 13 is used to both mount the guide and to provide passage for the elastic. As can be seen, the wide portion of the slot serves to mount the guide by receiving protrusion 7 from the foot. The narrow portion serves as the slot for the elastic. Once guide 11 is mounted, protrusion 7 serves as the back wall for the narrow portion, and screw 12 pushes the elastic against this protrusion. Since this version of the guide is typically used with smaller widths of elastic, a screw 12 with a smaller threaded portion can also be used. Other than these differences, the two embodiments function in the same way.

In an alternative method of use, if the screw is removed or if it is backed out so that it does not contact the material in the slot, then the material will feed through the slot without resistance. This allows the same attachment to be used for a ribbon or other nonstretchable trim material. In such a case, the guide slot serves as a guide which controls the placement of the trim material, but does not provide any pre-stretching function. This is another operation that the operator would have to manually perform in the absence of the guide.

Since elastic and other trim materials come in various widths, the size of the slot in the guide must be changed to accommodate these different widths. This is normally accomplished by providing multiple attachments with various width slots. Although trim materials come in various widths, they normally come in a small number of standard widths, such as one-quarter inch, three-eighths inch, one-half inch, etc. This places a limit on the number of slot widths and hence the number of attachments that are required to accommodate the majority of commonly available trim materials.

Figure 5A:
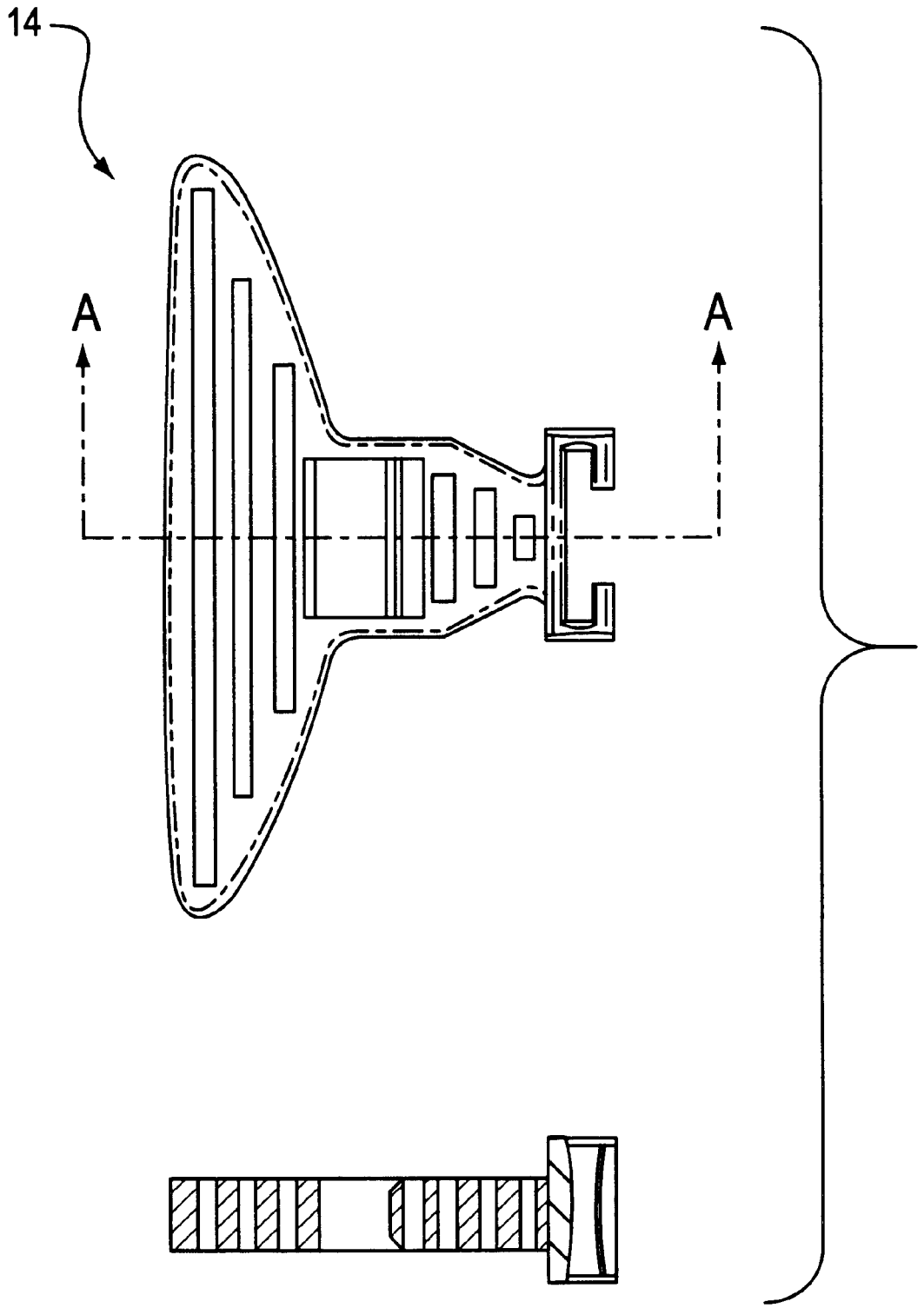
FIGS. 5A and 5B show guides for handling multiple trim pieces.
Figure 5B:
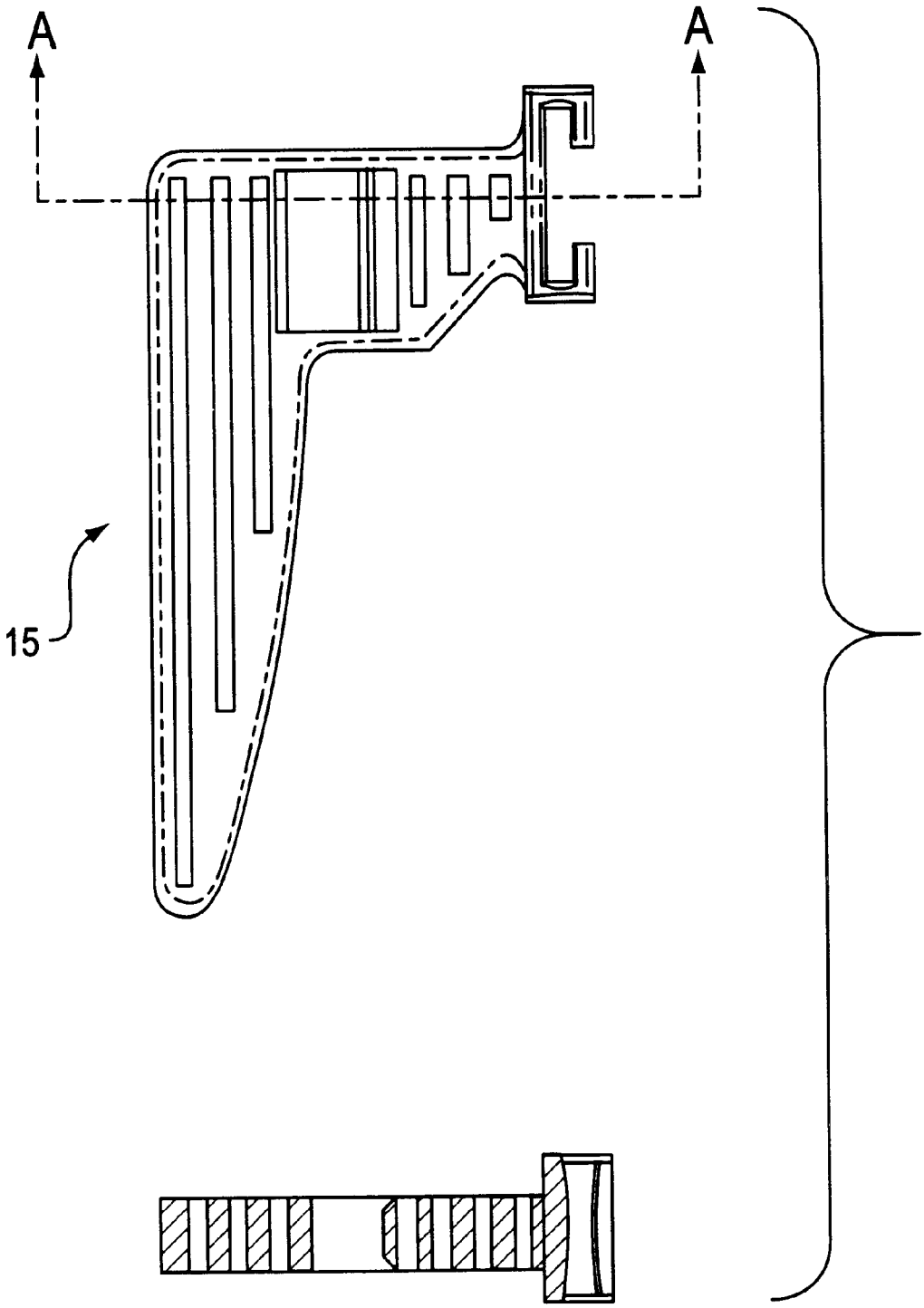

Sometimes the operator may wish to create a layered effect by sewing various ribbons or other trim materials, possibly of different widths and colors, on top of each other. The operator might wish to keep all of these ribbons centered, creating a layered effect that proceeds upward from either side. Alternatively, the operator may wish to align one edge of all the ribbons so that the layered effect proceeds upward from only one side. In either case, it is important to maintain the proper orientation and positional configuration of each item. Such precise control would be very difficult if the operator had to manually hold all of these materials in place while feeding them into the sewing mechanism. FIGS. 5A and 5B show guides which are designed to automate this process. As can be seen, each guide has multiple parallel slots. These slots can be of different widths to accommodate different width trim materials, and are also oriented so that the trim materials maintain their precise positional registration. FIG. 5A shows a guide 14 which centers all of the ribbons while FIG. 5B shows a guide 15 which aligns one side of the ribbons. Since not every slot must be used, the operator can use a single guide to sew one, two, or more trim materials together, up to the maximum number of slots. Since a single guide has slots in various widths, different width materials can also be accommodated in various combinations by a single guide, provided the proper widths are found somewhere on that guide. This further reduces the total number of attachments required to accommodate the majority of sewing needs.

Customization

The invention can be customized to meet the unique needs of each user in two ways. The sewing machine market contains a large number of brands and model numbers, and not all of these machines have feet which are compatible with each other. A variety of custom feet can be provided so that an individual user may select the one particular configuration which is compatible with his or her particular sewing machine. In addition, each user may have a variety of needs when it comes to sewing elastic or trim in various widths, quantities and configurations. A variety of guides makes it possible for each user to select only the guides needed for his or her particular sewing needs. In this manner the user may customize the foot to the particular machine and may customize the guides to the particular sewing needs. This allows every individual to select only the equipment needed without having to buy expensive equipment that was designed to provide all options for all users. The very simplicity of the invention allows each user to customize to his or her particular needs easily and inexpensively.

The embodiments described herein are illustrative and not restrictive. Numerous variations may occur to those of skill in the art that fall within the spirit of the invention. The scope of the invention is therefore limited not by the particular examples described herein, but only by the scope of the attached claims.

What is claimed is:

1. A sewing machine guide assembly for controlling material being sewn by a sewing machine, said guide assembly comprising:

an alignment portion for aligning said material;

a sewing machine foot;

a mounting portion for detachably connecting said alignment portion to said foot;

wherein said mounting portion includes a mounting slot with sides and a first interior space;

wherein said foot includes a protrusion for insertably fitting within said mounting slot; and wherein said alignment portion includes an alignment slot with sides and a second interior space for allowing said material to controllably pass through said alignment portion.

2. The guide of claim 1, said alignment portion further including an adjustment device for controllably exerting a frictional force on said material within said slot.

3. The guide of claim 2, wherein said adjustment device is a screw.

4. The guide of claim 1, wherein said alignment portion further includes a plurality of slots, each of said slots for allowing said material to controllably pass through said guide.

5. The guide of claim 4, wherein said plurality of slots are in predetermined alignment with each other.

6. The guide of claim 5, wherein said plurality of slots are parallel to each other.

7. The guide of claim 5, wherein said plurality of slots are centrally aligned with each other.

8. The guide of claim 5, wherein said plurality of slots are edge-aligned with each other.

9. The guide assembly of claim 1, wherein said first and second interior spaces are noncontiguous with each other.

10. The guide assembly of claim 1, wherein:

said alignment slot includes an open side;

said mounting slot includes an open side; and the open side of said alignment slot and the open side of said mounting slot are co-located such that said first interior space is contiguous with said second interior space.

11. A method of sewing elastic material with a sewing machine, said method comprising the steps of:

providing a guide with at least one slot for controlling said elastic material;

feeding said elastic material into a sewing mechanism of said sewing machine by passing said elastic material through said at least one slot; and adjusting an adjustment screw on said guide until said adjustment screw presses against said elastic material to controllably prestretch said elastic material as it feeds into said sewing mechanism.

12. A sewing machine guide assembly for controlling material being sewn by a sewing machine, said guide assembly comprising:

an alignment portion;

a mounting portion connected to a sewing machine shank;

wherein one of said mounting portion and said alignment portion includes a mounting slot;

wherein the other of said mounting portion and said alignment portion includes a protrusion adapted to insertably fit within said mounting slot; and wherein said mounting portion and said alignment portion are configured so that the mounting portion is detachably connected to the alignment portion solely by placement of said protrusion in said mounting slot.

13. A method of sewing materials with a sewing machine, said method comprising the steps of:

providing an alignment guide with one of:

a mounting slot; and a protrusion for inserting into said mounting slot;

providing a mounting element connected to said sewing machine with the other of:

said mounting slot; and said protrusion for inserting into said mounting slot;

mounting said alignment guide to said mounting element solely by inserting said protrusion into said mounting slot;

feeding at least one material through at least one alignment slot in said alignment guide; and sewing said materials after said materials exit said alignment slots.

* * * * *